United States Patent [19]

Fleming

[11] Patent Number: 4,643,667

[45] Date of Patent: Feb. 17, 1987

[54] NON-CATALYTIC POROUS-PHASE COMBUSTOR

[75] Inventor: Donald K. Fleming, Park Ridge, Ill.

[73] Assignee: Institute of Gas Technology, Chicago, Ill.

[21] Appl. No.: 800,406

[22] Filed: Nov. 21, 1985

[51] Int. Cl.[4] ..... F23D 13/12

[52] U.S. Cl. ..... 431/7; 431/328

[58] Field of Search ..... 431/328, 329, 7, 326; 126/92 AC

[56] References Cited

U.S. PATENT DOCUMENTS

| | | | |
|---|---|---|---|
| 1,830,826 | 11/1931 | Cox | 431/328 |
| 3,199,573 | 8/1965 | Flynn | 431/329 |
| 3,216,478 | 11/1965 | Saunders et al. | 431/329 |
| 3,270,798 | 9/1966 | Ruff | 431/329 |
| 3,738,793 | 6/1973 | Reid et al. | 431/328 |
| 3,912,443 | 10/1975 | Ravault et al. | 431/328 |
| 4,154,568 | 5/1979 | Kendall et al. | 431/328 X |

*Primary Examiner*—Margaret A. Focarino

*Attorney, Agent, or Firm*—Thomas A. Speckman

[57] ABSTRACT

A non-catalytic porous-phase combustor and process for generating radiant energy wherein the gas phase reaction and combustion take place within the pores of a multilayer porous plate to provide higher combustion intensity and to provide a greater proportion of heat released by radiation. The combustor comprises a porous plate having at least two discrete and contiguous layers, a first preheat layer comprising a material having a low inherent thermal conductivity and a second combustion layer comprising a material having a high inherent thermal conductivity and providing a radiating surface. Combustion intensities of about 400,000 to about 750,000 Btu/hr-ft$^2$ may be achieved in the combustion layer of the porous phase combustor.

20 Claims, 1 Drawing Figure

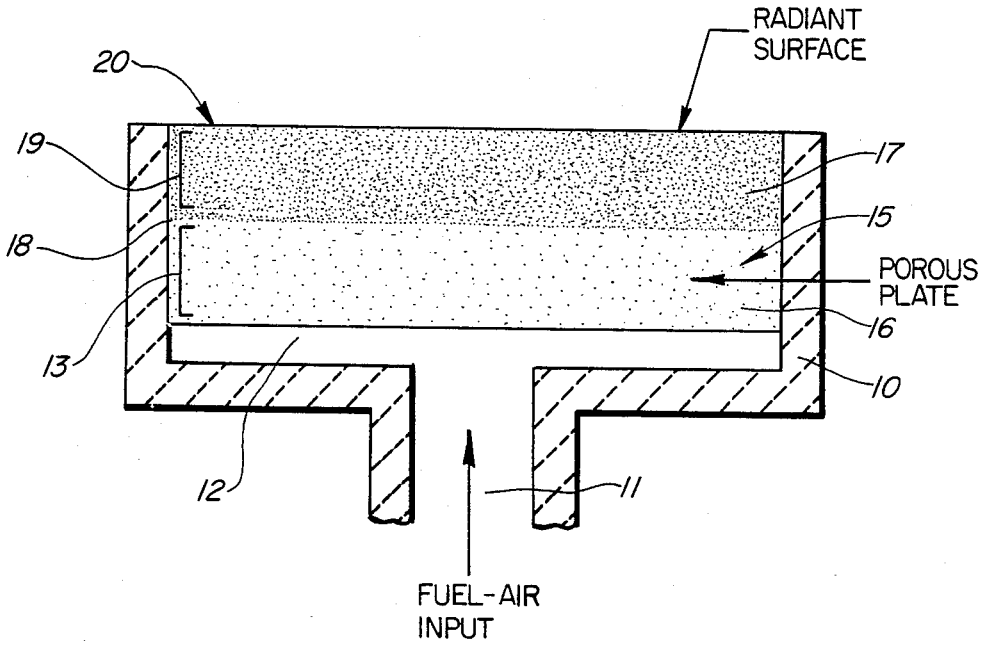
RADIANT SURFACE
20
19
17
18
15
POROUS PLATE
16
13
10
12
11
FUEL-AIR INPUT

NON-CATALYTIC POROUS-PHASE COMBUSTOR

BACKGROUND OF THE INVENTION

1. Field of the Invention

This invention relates to an improved non-catalytic, porous-phase combustor comprising a multi-layered porous plate wherein the gas phase reaction and the actual combustion take place within the pores of a porous plate to provide higher combustion intensity and to provide a greater proportion of heat release by radiation and to an improved process for generating radiant energy. The improved combustor preferably comprises a porous plate having at least two discrete and contiguous layers, a first porous layer comprising a material having a low inherent thermal conductivity wherein fuel is preheated, and a second porous layer comprising a material having a high inherent thermal conductivity wherein combustion takes place. This combustor design generates radiant energy with improved energy efficiency, enhances the combustion intensity of the porous phase reaction of fuel and oxidant within the pores of the plate, reduces noxious pollutant emissions, and reduces flashback due to the inherent thermal conductivities of the porous plate materials.

2. Description of the Prior Art

In general, heat energy may be transmitted by conduction, convection or radiation. Heat transmission by radiation and utilization of infrared energy has many advantages over conventional heat transmission by convection and conduction, particularly for many types of industrial applications. The operation and construction of infrared burners and radiant heaters is relatively simple, and thus more economical than other type of heat generation means. The intensity of radiant heat may be precisely controlled for greater efficiency, and infrared energy may be focused, reflected, or polarized in accordance with the laws of optics. In addition, radiant heat is not ordinarily affected by air currents.

Conventional gas fired infrared burners utilize flame energy or hot gases to heat a radiating refractory or other material, and thereby produce an approximately flat flame on or above the radiating surface.

Several types of gas fired infrared generators are currently available. Radiant tube burners comprise internally fired radiation units wherein the radiating surface is interposed between the flame and the load. Surface combustion infrared burners have a radiating burner surface comprising a porous refractory. The combustion mixture is conveyed through the porous refractory and burns above the surface to heat the surface by conduction. A third type of gas fired infrared generator comprises a burner having a radiating refractory surface heated directly with a gas flame. A fourth type of infrared generator utilizes a porous catalyst bed to oxidize fuel at a low temperature in a low temperature catalytic burner. These types of gas fired infrared generators may be utilized in a variety of industrial applications, including space heating, drying operations, food processing, thawing materials and equipment, and miscellaneous processes, including condensation control, metal heating, chemical processing and glass industry applications.

U.S. Pat. No. 3,751,213 teaches a high intensity radiant gas burner having a ceramic honeycomb radiant element wherein combustion takes place within the cells of the honeycomb as well as in the combustion chamber. The material comprising the gas injection block, positioned just downstream from the combustion chamber, is chosen on the basis of its density, taking into account the uniformity of gas flow, thermal insulating properties, and durability of materials having various densities. Intrinsic thermal conductivities of materials of construction are not considered and, in fact, it is preferred that the entire structure comprise alumina, the intrinsic thermal conductivity of all elements therefore being the same.

Japanese Pat. No. 55025773 teaches an infrared burner having a honeycomb ceramic burner coated with an aqueous solution of magnesia-lithium silicate. The aqueous coating is then fired to form a conductive layer. Combustion takes place at individual pores on the surface of the conductive layer, and the conductive layer promotes even heat distribution.

U.S. Pat. No. 3,738,793 teaches an illumination burner having a layered porous structure, the layered pores maintaining a stable flame in a thoria-ceria illumination burner. Combustion does not occur within the pores of the combustor, but on the surface of the top layer.

U.S. Pat. No. 3,912,443 teaches a layered ceramic radiant gas burner wherein the outer radiating layer comprises a coarsely porous ceramic material and an inner gas distributing layer comprises a finely porous, highly permeable ceramic material.

U.S. Pat. No. 3,270,798 teaches a catalytic radiant burner having a lower density porous layer and a higher density porous layer, the lower density layer providing insulation and preventing flashback with flameless catalytic combustion in the catalytic layers.

U.S. Pat. No. 4,483,673 teaches a catalytic combustion burner having a heat insulation diffusion layer.

U.S. Pat. No. 3,833,338 teaches a surface combustion burner having a thermally conductive layer, such as foamed metal, to back the ceramic fiber layer to reduce the risk of flashback.

U.S. Pat. No. 3,947,233 teaches a free burner wherein the flames burn above the burner heat surface.

U.S. Pat. No. 4,090,476 teaches a radiation boiler containing a radiating substance providing flameless, non-catalytic combustion.

U.S. Pat. Nos. 4,047,876 and 4,154,568 teach catalytic combustion within a bed.

SUMMARY OF THE INVENTION

It is an object of the present invention to provide high intensity combustion within a non-catalytic porous phase combustor, and to thereby provide greater heat release as radiation. It is a further object of the present invention to provide a non-catalytic porous phase combustor having enhanced turn-down capabilities and reduced flashback.

It is yet another object of the present invention to provide a non-catalytic porous phase combustor providing greater heat release as radiation, and generating a low level of noxious emissions.

It is still another object of the present invention to provide an improved process for efficiently generating radiant energy.

Porous refractory infrared burners can be operated in at least two modes. The conventional mode of operation is herein referred to as the preheat mode, and it is characterized by the fact that combustion takes place just above the porous surface, and the radiating surface is thus heated by hot gases above the surface. This type of burner is used both commercially and industrially. A second mode of operation is herein referred to as the reactor mode, wherein substantially all combustion occurs within the pores of a porous plate, while any unreacted fuel reacts directly on or above the radiating surface of the plate. The radiating surface thus receives heat energy by convection from within the plate and conduction from both inside and outside the radiating surface. The present invention is designed for use in the reactor mode of operation.

The non-catalytic porous phase combustor according to the present invention comprises a fuel/air input means for introducing a combustible mixture into a confined region of the combustor, a distribution chamber for evenly distributing the combustible mixture over the surface area of a porous plate, a multilayer porous plate comprising at least two discrete and contiguous layers, a first porous layer comprising a material of relatively low inherent thermal conductivity and a second porous layer comprising a material having a relatively high inherent thermal conductivity, a radiating surface adjacent the second porous layer for emitting heat energy as radiant energy, and confining means for confining the multilayer porous plate and the combustible mixture so that it passes sequentially through the first porous region and subsequently into the second porous region wherein substantially all combustion occurs.

The first porous layer of the multilayer porous plate, comprising a material having relatively low inherent thermal conductivity, serves to gradually preheat the incoming combustible mixture to nearly ignition temperature as the combustible mixture approaches the interface between the two layers. In operation, the low thermal conductivity porous layer is heated by conduction from the high thermal conductivity porous layer wherein combustion is taking place. As a result of conduction of heat from the high thermal conductivity porous layer, a temperature gradient is established in the low thermal conductivity porous layer, the temperature of the low thermal conductivity porous layer approaching ignition temperatures near its interface with the high thermal conductivity porous layer and decreasing across the depth of the layer as the distance from the interface with the high thermal conductivity layer increases. Heat transfer from the high thermal conductivity layer to the low thermal conductivity porous layer is limited, however, by the low inherent thermal conductivity of the material comprising the low thermal conductivity porous plate, and preheat temperatures are therefore maintained in the low thermal conductivity porous layer without requiring any external controls and without limiting combustion temperatures and/or intensity in the high thermal conductivity layer. Due to the low inherent thermal conductivity of the material comprising the first porous layer, the incidence of flashback from the combustion zone in the high thermal conductivity layer to the preheat zone in the low thermal conductivity layer is substantially reduced, regardless of the combustion temperature and intensity.

The high inherent thermal conductivity of the porous material comprising the second layer serves to conduct heat from an initial surface flame to the interior of the matrix when the burner is initially lit. As the internal temperature of the high thermal conductivity porous layer rises, the flame front moves downwardly through the high thermal conductivity porous layer, and a combustion zone is established within the high thermal conductivitiy layer. As combustion occurs within the pores of the high thermal conductivity layer, heat energy is conducted from the combustion zone to the outer surface of the high thermal conductivity layer, where heat is converted to radiation by means of the radiating surface layer.

One important advantage of the present invention over prior art porous plate combustors is that the porosity and density of the material comprising the porous plate may be varied within limits to achieve special effects or to accommodate different process parameters without affecting the operation and stability of the combustor since the inherent thermal conductivities of the materials comprising the multilayer porous plate is the primary control of combustor operation. An additional benefit of the present invention is the reduced formation of noxious pollutants such as NO and $N0_2$, generally referred to as $NO_x$. Reduced pollutant formation has been observed as a greater fraction of the heat content of the fuel is converted to radiation.

BRIEF DESCRIPTION OF THE DRAWING

Further features of the invention will be apparent from the following more detailed description taken in conjunction with the drawing which shows a highly schematic sectional view of a multi-layer porous plate combustor according to one embodiment of the present invention.

DESCRIPTION OF PREFERRED EMBODIMENTS

As shown in the figure, the non-catalytic porous phase combustor of the present invention comprises confining housing means 10 which retains multilayer porous plate 15, provides access to combustible mixture through combustible mixture inlet 11, and provides a combustible mixture distribution chamber 12. Housing means 10 comprises a rigid material which does not melt, decompose, or otherwise become altered at operating combustion temperatures and which does not react adversely with the combustible mixture. Suitable materials, such as cast iron, clay, ceramics, and the like, are well known to the art. It is preferred that housing means 10 is of a one-piece construction as shown in the figure, but housing structures comprising multiple componets joined together may also be utilized.

Multilayer porous plate 15 conforms closely to the inner surfaces of housing means 10 to prevent the escape of combustible mixture and to ensure that all combustible mixture introduced is directed through porous plate 15. Combustible mixture is introduced through combustible mixture inlet 11 in suitable volumes and at suitable pressures during operation of the porous phase combustor to ensure that combustion is uniform within porous plate 15. A lower limiting combustible mixture input rate and/or pressure is required to sustain continuous combustion, and an upper limiting combustible mixture input rate and/or pressure is imposed by the configuration of the porous plate and the pore volume provided in the combustion zone. Suitable combustible mixtures, such as methane/air, propane/air, town gas/air, and the like, a suitable input pressure of about 4 inches water column, and a suitable input rate of about 50,000 Btu/hr.-sq.ft., are well known to the art and may be determined upon routine experimental investigation.

Multilayer porous plate 15 comprises at least two discrete and contiguous layers, first layer 16 comprising material having a low inherent thermal conductivity and second layer 17 comprising a material having a high inherent thermal conductivity. As used in this disclosure and in the appended claims, the term "low inherent thermal conductivity" means thermal conductivities in the range of about ½ to about 3 Btu/hr - ft$^2$ - ° F/ft, and the term "high inherent thermal conductivity" means thermal conductivities within the range of about 3 to about 50 Btu/hr - ft$^2$ - ° F/ft. In a preferred embodiment, the ratio of thermal conductivity of the high thermal conductivity layer to the low thermal conductivity layer is from about 3 to about 15. Low thermal conductivity layer 16 preferably comprises a refractory material such as porous ceramic material, cordierite, silica, zirconia, alumina, and the like having a low inherent thermal conductivity. Second layer 17 having high inherent thermal conductivity preferably comprises a refractory material such as porous or fibrous metal which is capable of withstanding combustion temperatures without undergoing deformation, decomposition, or pore structure changes, such as high purity magnesia, silicon carbide, silicon nitride, and the like.

Since the thermal conductivity of first and second layers 16 and 17, respectively, depends upon the inherent thermal conductivity of the material of construction, the desired porosity of the two layers may be varied without significant influence on the thermal conductivity of the structure. First layer 16 preferably has a porosity within the range of about 10 percent to about 70 percent porosity, preferably about 15 to about 40 percent porosity, the pore sizes being relatively uniform (±15 percent) and ranging from about 0.01 to about 0.10 inch in diameter, preferably from about 0.04 to 0.07 inch in diameter. Second layer 17 preferably has a porosity ranging from about 10 percent to about 70 percent, preferably about 15 to about 40 percent porosity, with relatively uniform (±15 percent) pore sizes ranging from about 0.01 to about 0.10 inoh in diamter, preferably from about 0.04 to 0.07 inch in diameter. Low thermal conductivity layer 16 may be any convenient thickness to achieve even distribution and preheating of the combustible mixture. Thicknesses of about ¼ inch to ½ inch or greater are suitable. High thermal conductivity layer 17 is preferably relatively thin, suitable thicknesses ranging from about 1/16 inch to ¼ inch.

Radiating surface 20 is adjacent and co-extensive with the outer surface of second layer 17. Radiating surface 20 receives heat energy from multilayer porous plate 15 by conduction and directly converts the heat energy produced to radiant energy. The radiating surface is the outer surface of high thermal conductivity layer 17.

In operation, combustible fuel mixture is introduced through inlet 11, is distributed within distribution chamber 12, and enters porous low thermal conductivity layer 16 at a uniform rate per unit surface area. Low thermal conductivity layer 16 is heated by heat conduction from combustion within high thermal conductivity layer 17. A thermal gradient is thus established within low thermal conductivity layer 16 with the lowest temperature at the interface of low thermal conductivity layer 16 with distribution chamber 12 and the highest temperatures at interface 18 between low thermal conductivity layer 16 and contiguous high thermal conductivity layer 17. Combustible mixture is gradually preheated to temperatures approaching combustion temperatures within preheat zone 13 of low thermal conductivity layer 16, yet combustion temperatures are not attained within first layer 16 due to the low inherent thermal conductivity of the material comprising first layer 16. The depth or thickness of preheat zone 13 varies as a function of the intensity of combustion within high thermal conductivity layer 17 and/or the rate of combustible mixture input.

As preheated combustible mixture at temperatures just below combustion temperatures crosses interface 18 between the layers and enters porous high thermal conductivity layer 17, ignition of the combustible mixture occurs and combustion takes place within the pores of high thermal conductivity layer 17. Substantially all combustible mixture is burned within combustion zone 19 in high thermal conductivity layer 17 and any unreacted fuel reacts directly on or above radiating surface 20. Because second layer 17 comprises a material having high thermal conductivity, combustion temperatures are maintained substantially throughout high thermal conductivity layer 17, as shown by combustion zone 19, and combustion may occur substantially throughout high thermal conductivity layer 17, depending upon the rate of combustible mixture input. The high thermal conductivity of the material comprising second layer 17 effects the transfer of heat from the reaction zone within second layer 17 to the outer surface of the porous plate, where energy is emitted by radiation from radiating surface 20. When combustion has been initiated on the surface of the multilayer porous plate of the present invention and subsequently transferred to the interior of the high thermal conductivity layer, combustion intensity may be increased from a typical maximum measurement of about 90,000 Btu/hr - ft$^2$ to about 400,000 to 750,000 Btu/hr - ft$^2$.

It will be obvious to those skilled in the art that various modifications may be made in the invention without departing from the spirit and scope thereof, and therefore the invention is not intended to be limited to the embodiments shown in the drawings and described in the specification.

I claim:

1. A non-catalytic porous phase combustor comprising: housing means for retaining a porous plate across one open end and confining a combustible mixture in a distribution chamber across the opposite end; input means for introducing a combustible mixture into said distribution chamber; and a multilayer porous plate comprising at least two discrete and contiguous porous layers, a first layer adjacent said distribution chamber comprising a material having a low inherent thermal conductivity, and a second layer adjacent said open end comprising a material having a high inherent thermal conductivity and having a radiating outer surface for emitting heat energy as radiant energy, said first and second layers having pores of substantially the same size.

2. A non-catalytic porous phase combustor according to claim 1 wherein said first layer comprises a material having an inherent thermal conductivity of from about ½ to about 3 Btu/hr-ft$^2$-° F/ft.

3. A non-catalytic porous phase combustor according to claim 2 wherein said second layer comprises a material having an inherent thermal conductivity of from about 3 to about 50 Btu/hr - ft$^2$ - ° F/ft.

4. A non-catalytic porous phase combustor according to claim 3 wherein a ratio of said inherent thermal conductivity of said second layer to said inherent thermal conductivity of said first layer is from about 3 to about 15.

5. A non-catalytic porous phase combustor according to claim 2 wherein said first layer comprises a refractory material selected from the group consisting of: cordierite, zirconia, silica, alumina, and ceramic materials.

6. A non-catalytic porous phase combustor according to claim 3 wherein said second layer comprises a refractory material selected from the group consisting of: high purity magnesia, silicon carbide, and silicon nitride.

7. A non-catalytic porous phase combustor according to claim 3 wherein said first layer and said second layer both have a porosity of about 10 percent to about 70 percent.

8. A non-catalytic porous phase combustor according to claim 7 wherein said first layer and said second layer both have a porosity of about 15 percent to about 40 percent.

9. A non-catalytic porous phase combustor according to claim 7 wherein the pore sizes in said first and second layers are from about 0.01 to about 0.10 inch in diameter.

10. A non-catalytic porous phase combustor according to claim 9 wherein said pore sizes in said first and second layers are from about 0.04 to 0.07 inch in diameter.

11. A non-catalytic porous phase combustor according to claim 1 wherein a ratio of said inherent thermal conductivity of said second layer to said inherent thermal conductivity of said first layer is from about 3 to about 15.

12. A non-catalytic porous phase combustor according to claim 11 wherein the thickness of said first layer is about ¼ inch to about ½ inch and the thickness of said second layer is about 1/16 inch to about ¼ inch.

13. An improved process for generating radiant energy comprising the sequential steps of:

introducing a combustible mixture through an inlet means and distributing said combustible mixture within a distribution chamber;

passing said combustible mixture through and preheating said combustible mixture in pores of a first discrete layer of a multilayer porous plate, said first layer comprising a material having a low inherent thermal conductivity;

passing said combustible mixture through and combusting said combustible mixture in pores of a second discrete layer of said multilayer porous plate, said pores of said second layer being of substantially the same size as said pores of said first layer, said second layer comprising a material having a high inherent thermal conductivity; and converting heat energy produced by said combustion to radiant energy at a radiating surface on said second layer and emitting said radiant energy from said radiating surface.

14. An improved process for generating radiant energy according to claim 13 wherein said combustible mixture is selected from the group consisting of: methane/air, propane/air and town gas/air.

15. An improved process for generating radiant energy according to claim 13 wherein said combustible mixture is preheated to temperatures approaching combustion temperature in said first layer.

16. An improved process for generating radiant energy according to claim 15 wherein a thermal gradient is established within said first layer, with the lowest temperature at the interface of said first layer with said distribution chamber and the highest temperature at the interface of said first layer and said second layer.

17. An improved process for generating radiant energy according to claim 15 wherein combustion temperatures are maintained substantially throughout said second layer.

18. An improved process for generating radiant energy according to claim 16 wherein substantially all combustible mixture is consumed within said second layer.

19. An improved process for generating radiant energy according to claim 13 wherein combustion is initiated on said radiating surface and is subsequently transferred to the interior of said second layer.

20. An improved process for generating radiant energy according to claim 13 wherein the combustion intensity in said second layer is from about 400,000 to about 750,000 Btu/hr - $ft^2$.

* * * * *